US008567936B2

(12) United States Patent
Edwards

(10) Patent No.: US 8,567,936 B2
(45) Date of Patent: Oct. 29, 2013

(54) LED ROLL TO ROLL DRUM PRINTER SYSTEMS, STRUCTURES AND METHODS

(75) Inventor: Paul Andrew Edwards, Ypsilanti, MI (US)

(73) Assignee: Electronics for Imaging, Inc., Foster City, CA (US)

( * ) Notice: Subject to any disclaimer, the term of this patent is extended or adjusted under 35 U.S.C. 154(b) by 404 days.

(21) Appl. No.: 12/943,843

(22) Filed: Nov. 10, 2010

(65) Prior Publication Data

US 2012/0113199 A1 May 10, 2012

(51) Int. Cl.

| | |
|---|---|
| ***B41J 2/01*** | (2006.01) |
| ***B41J 2/15*** | (2006.01) |
| ***B41J 2/145*** | (2006.01) |

(52) U.S. Cl.

USPC ..... 347/102; 347/40

(58) Field of Classification Search

None

See application file for complete search history.

(56) References Cited

U.S. PATENT DOCUMENTS

| | | | | |
|---|---|---|---|---|
| 2,927,502 | A | 3/1960 | Watrous | |
| 4,326,001 | A | 4/1982 | Sachs et al. | |
| 4,952,973 | A | 8/1990 | Jones et al. | |
| 5,099,256 | A * | 3/1992 | Anderson | 347/103 |
| 5,267,005 | A | 11/1993 | Yamamoto et al. | |
| 5,284,506 | A | 2/1994 | Barbe | |
| 5,294,946 | A | 3/1994 | Gandy et al. | |
| 5,792,296 | A | 8/1998 | Soltysiak | |
| 6,126,095 | A | 10/2000 | Matheson et al. | |
| 6,154,232 | A * | 11/2000 | Hickman et al. | 347/40 |
| 6,335,140 | B1 | 1/2002 | Miyazaki | |
| 6,461,064 | B1 * | 10/2002 | Leonard et al. | 400/328 |
| 6,522,349 | B1 | 2/2003 | Lee | |
| 6,550,905 | B1 | 4/2003 | Deckers | |
| 6,550,906 | B2 | 4/2003 | Ylitalo | |
| 6,554,414 | B2 | 4/2003 | Ylitalo et al. | |
| 6,593,390 | B1 | 7/2003 | Johnson et al. | |
| 6,598,531 | B2 * | 7/2003 | Nedblake et al. | 101/490 |
| 6,683,421 | B1 | 1/2004 | Kennedy et al. | |
| 6,736,918 | B1 | 5/2004 | Ichikawa et al. | |

(Continued)

FOREIGN PATENT DOCUMENTS

| | | |
|---|---|---|
| EP | 1913979 | 4/2008 |
| JP | 2010-000742 | 1/2010 |

(Continued)

OTHER PUBLICATIONS

Jack Kenny, UV Curing Technology, Mar. 2009, Label & Narrow Web.

*Primary Examiner* — Stephen Meier
*Assistant Examiner* — Leonard S Liang
(74) *Attorney, Agent, or Firm* — Michael A. Glenn; Perkins Coie LLP

(57) ABSTRACT

An enhanced printing system comprises a drum structure, a print carriage for delivering LED curable ink there from, such as from one or more print heads, and one or more LED light sources for curing the delivered ink. Some embodiments may preferably further comprise one or more LED pining stations, such as to control, slow or stop the spread of ink drops. As well, some printer embodiments may comprise a mechanism to deliver any of an inert gas, e.g. nitrogen, or other gas that is at least partially depleted of oxygen, between the LED energy source and the substrate. The disclosed LED printing structures typically provide higher quality and/or lower cost as compared to prior art systems, for a wide variety of printing matter output, such as for but not limited to super wide format (SWF) output, wide format (WF) output, packaging, labeling, or point of sale displays or signage.

30 Claims, 12 Drawing Sheets

(56) References Cited

U.S. PATENT DOCUMENTS

| | | | | |
|---|---|---|---|---|
| 6,789,873 | B2 * | 9/2004 | Booth | 347/22 |
| 6,927,014 | B1 | 8/2005 | Figov | |
| 7,278,728 | B2 | 10/2007 | Desie et al. | |
| 7,419,716 | B2 | 9/2008 | Tian et al. | |
| 7,431,897 | B2 | 10/2008 | Hahne et al. | |
| 7,520,601 | B2 | 4/2009 | Claes et al. | |
| 8,186,801 | B2 * | 5/2012 | Saita | 347/19 |
| 2001/0052924 | A1 | 12/2001 | Steinke et al. | |
| 2002/0071000 | A1 * | 6/2002 | Rezanka | 347/42 |
| 2002/0119395 | A1 | 8/2002 | Kramer et al. | |
| 2002/0149659 | A1 | 10/2002 | Wu et al. | |
| 2003/0164571 | A1 | 9/2003 | Crump et al. | |
| 2003/0227527 | A1 * | 12/2003 | Richards | 347/102 |
| 2004/0029030 | A1 | 2/2004 | Murray | |
| 2004/0166249 | A1 | 8/2004 | Siegel et al. | |
| 2006/0066703 | A1 | 3/2006 | Kadomatsu et al. | |
| 2006/0066704 | A1 * | 3/2006 | Nishida | 347/103 |
| 2006/0119686 | A1 | 6/2006 | Odell | |
| 2006/0158473 | A1 | 7/2006 | Mills et al. | |
| 2006/0182937 | A1 | 8/2006 | Tsuchimura | |
| 2006/0197787 | A1 | 9/2006 | Kusunoki et al. | |
| 2006/0221161 | A1 * | 10/2006 | Hori | 347/103 |
| 2007/0013757 | A1 | 1/2007 | Ohnishi | |
| 2007/0040885 | A1 | 2/2007 | Kusunoki | |
| 2007/0058020 | A1 | 3/2007 | Wetjens et al. | |
| 2007/0115335 | A1 | 5/2007 | Vosahlo et al. | |
| 2007/0120930 | A1 | 5/2007 | Domoto et al. | |
| 2007/0154823 | A1 | 7/2007 | Marson et al. | |
| 2007/0171263 | A1 | 7/2007 | Inoue et al. | |
| 2007/0184141 | A1 | 8/2007 | Custer et al. | |
| 2008/0018682 | A1 * | 1/2008 | Spehrley et al. | 347/10 |
| 2008/0024548 | A1 | 1/2008 | Shang et al. | |
| 2008/0156506 | A1 | 7/2008 | Wagner et al. | |
| 2008/0158278 | A1 | 7/2008 | Inoue | |
| 2008/0192075 | A1 | 8/2008 | Campion et al. | |
| 2008/0192100 | A1 | 8/2008 | Nakajima et al. | |
| 2008/0218574 | A1 * | 9/2008 | Furuno et al. | 347/100 |
| 2009/0085996 | A1 | 4/2009 | Kasai | |
| 2009/0086000 | A1 * | 4/2009 | Yokota | 347/102 |
| 2009/0122126 | A1 * | 5/2009 | Ray et al. | 347/102 |
| 2009/0207223 | A1 * | 8/2009 | Cofler et al. | 347/102 |
| 2009/0207224 | A1 * | 8/2009 | Cofler | 347/102 |
| 2009/0246382 | A1 * | 10/2009 | Hirato et al. | 427/265 |
| 2010/0177151 | A1 | 7/2010 | Thompson et al. | |
| 2010/0208020 | A1 * | 8/2010 | Matsumoto | 347/102 |
| 2010/0259589 | A1 | 10/2010 | Barry et al. | |
| 2010/0309269 | A1 | 12/2010 | Vosahlo et al. | |

FOREIGN PATENT DOCUMENTS

| | | | |
|---|---|---|---|
| JP | 2010069682 | A * | 4/2010 |
| JP | 2010269574 | A * | 12/2010 |
| WO | WO-2008001051 | | 1/2008 |

* cited by examiner

LED ROLL TO ROLL DRUM PRINTER SYSTEMS, STRUCTURES AND METHODS

BACKGROUND OF THE INVENTION

1. Field of the Invention

The present teachings relate to ink jet printers and, more particularly, relate to roll to roll ink jet printers having a print head using light emitting diodes (LEDs).

2. Background

Historically, roll to roll inkjet printers have been used to create prints that are viewed at long distances, such as for paper or vinyl billboard prints. Such prints are not typically required to be of high quality, and the technology used for many years was solvent inks.

More recently, UV ink technology has been applied to roll to roll inkjet printers, which has allowed the printing of a greater range of substrates and at improved print quality. For example, FIG. 1 shows a first exemplary Roll to Roll printer 10 having UV curing 24. In the exemplary printer 10 seen in FIG. 1, a substrate 14 is moved 18, such as over an inlet roller 16, a plurality of rollers 12, over a cooling mechanism 26, and an outlet roller 28. A print carriage 20 comprising one or more inkjet heads 22 applies ink to the substrate 14 as it passes over the rollers 12. The ink on the substrate 14 is then cured by one or more UV curing lamps 24, which may be located over a cooling mechanism 26.

While such UV printers have provided adequate quality for a limited range of printing applications, UV light sources 24 commonly heat the both substrate 14 and neighboring surfaces of the printing mechanisms to as much as 150 to 200 degrees Fahrenheit (F), which may commonly cause problems for any of placement accuracy of the UV curable ink drops 22, or accurate positioning or movement of substrates 14. For example, heat from UV light sources 24 readily builds up though substrates 14 and rollers, which can cause many substrates, especially thin or temperature sensitive substrates, to stretch or wrinkle, making it difficult for the substrate to print-head gap to remain accurate or constant. Such heat build up typically restricts the types of substrates 14 that can be used in UV printers.

Printers having UV light sources 24 may provide cooling of the substrate, such as with a chilled platen or other cooling mechanism 26, wherein cooling water may typically be circulated to chill a metal platen in contact with the substrate 14. As well, some UV printers have cooling water pass through tubes that resist UV absorption, located between the UV light sources 24 and the substrate 14, to reduce heat that would otherwise reach the substrate.

There is an ongoing need for higher quality prints, with higher resolution, which has been driven by the desire to produce a wide variety of printing products, such as but not limited to any of point of purchase (POP) items, labels, and packaging, where close up viewing is a requirement. Increases in printer throughput are a continuing requirement that is driven by customer costs and competition.

In recent years, this has driven the cost of printer design higher, as more heads have often been required, such as to increase print speed and/or to increase printer tolerances. As well, chilled platens have been used, such as with thermoelectric devices, or the region near UV lamps has been chilled, such as by running cooling water in front of lamps, such as to provide motion quality for the expanded range of substrates, e.g. thinner and/or temperature sensitive substrates, and the requirement for improved drop placement accuracy.

While such UV printers have provided adequate quality for some printing applications, UV light sources 24 commonly heat the both substrate and the neighboring surface of the drum to as much as 150 to 200 degrees Fahrenheit (F). For mercury vapor printing systems, substrates are commonly heated to as much as 150 to 220 degrees F., depending upon such factors as lamp type, power output and speed setting. Even with chilling and a low power setting, mercury vapor printing systems commonly heat substrates to over 100 degrees F.

It would be advantageous to provide a printing system that can produce a wide variety of printed matter with high resolution that can be viewed close up, such as for point of purchase (POP) items, labels, and packaging. The development of such a printing system would constitute a major technological advance.

As well, it would be advantageous to provide such a printing system that can produce a wide variety of printed matter on a wide variety of substrates, such as for thin and/or temperature sensitive substrates. The development of such a printing system would constitute a further technological advance.

In addition, it would be advantageous to provide such a printing system that can produce a wide variety of printed matter on a wide variety of substrates, without the necessity of platen chilling. The development of such a printing system would constitute a further technological advance.

Some recent flat printers having flat platens have used LED curing for applied ink. FIG. 2 shows a second exemplary inkjet printer 30 having LED curing 38 for a flat platen 32. For example, substrate media 40 may be placed or positioned between a print head assembly 34 and a platen 32, wherein the printer 30 comprises one or more heads 36, and one or more LED light sources 38.

While such flat format printers 30 have begun to implement LED curing, such flat printer configurations are often expensive and may only provide a limited range to printed output.

It would therefore be advantageous to provide a printing system that can cost-effectively produce a wider variety of printed matter across a wider range of substrates. The development of such a printing system would constitute a further technological advance.

SUMMARY

An enhanced printing system comprises a drum structure, a print carriage for delivering LED curable ink there from, such as from one or more print heads, and one or more LED light sources for curing the delivered ink. Some embodiments may preferably further comprise one or more LED pining stations, such as to control, slow or stop the spread of ink drops. As well, some printer embodiments may comprise a mechanism to deliver any of an inert gas, e.g. nitrogen, or other gas that is at least partially depleted of oxygen, between the LED energy source and the substrate. The disclosed LED printing structures may provide higher quality and/or lower cost as compared to prior art systems, for a wide variety of printing matter output, such as for but not limited to super wide format (SWF) output, wide format (WF) output, labels, packaging, or point of sale displays or signage.

DETAILED DESCRIPTION

Figure 2:
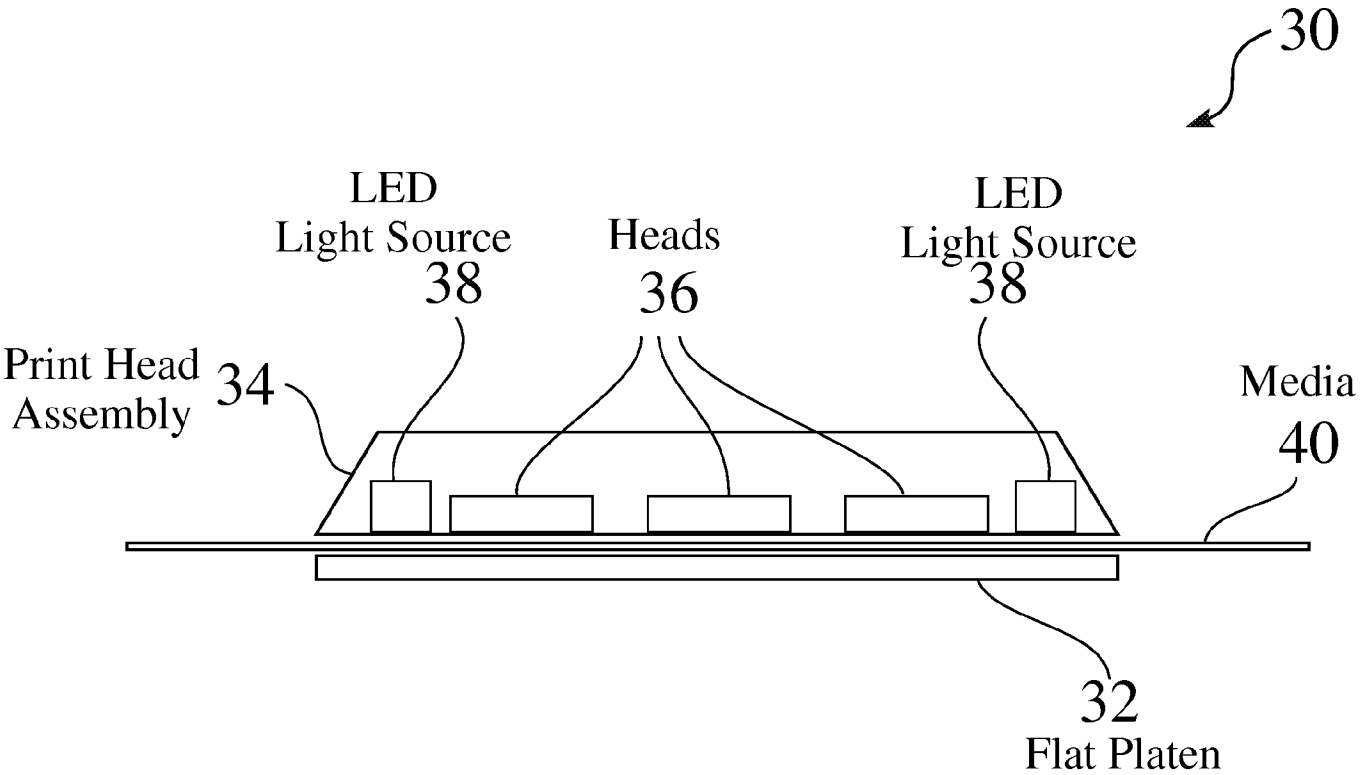
Fig. 2 (PRIOR ART)
FIG. 2 shows an exemplary printer having LED curing for a flat platen.
Figure 3:
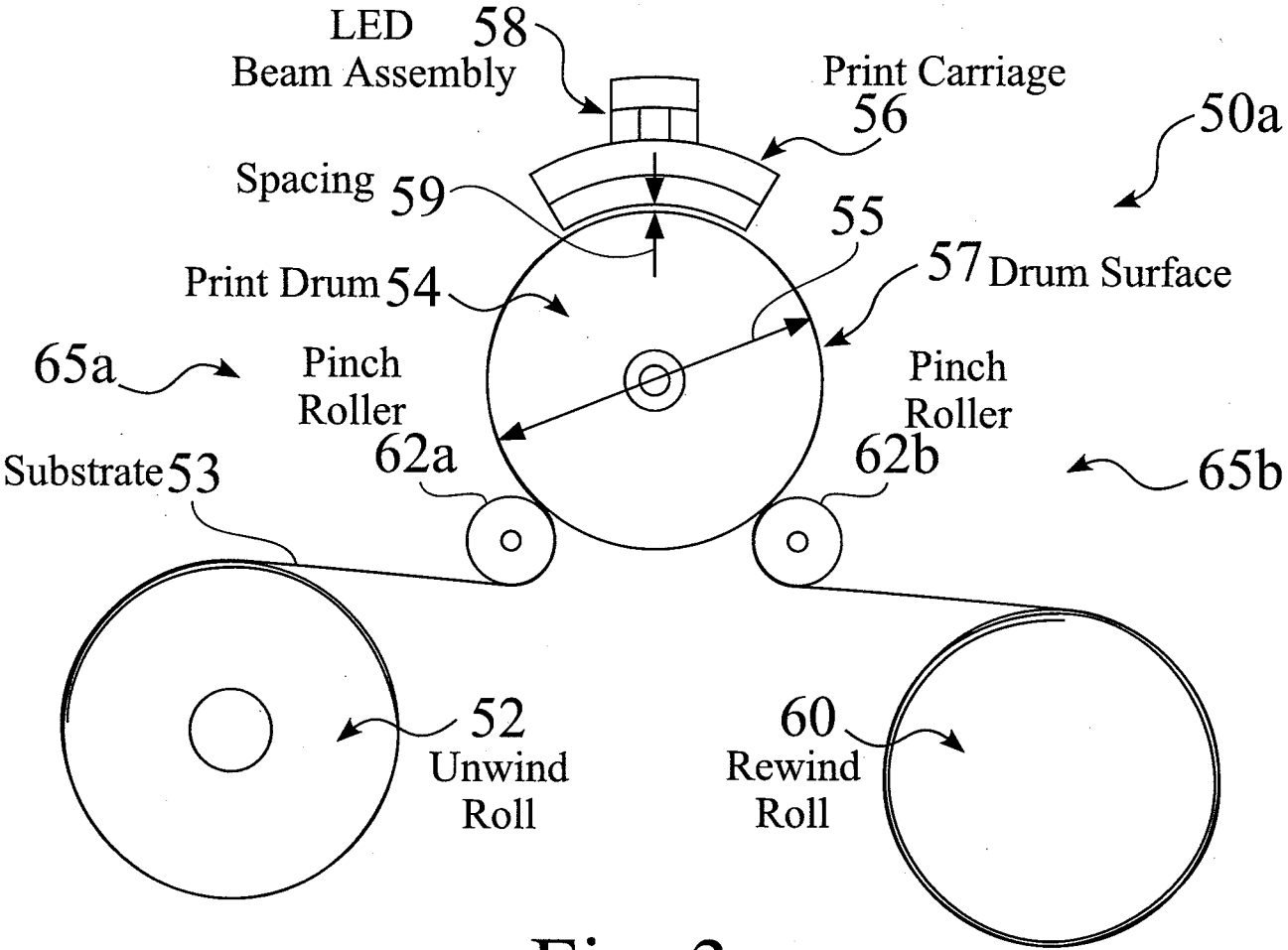
FIG. 3 is a schematic side view of a first exemplary embodiment of an LED Roll to Roll printer.
Figure 4:
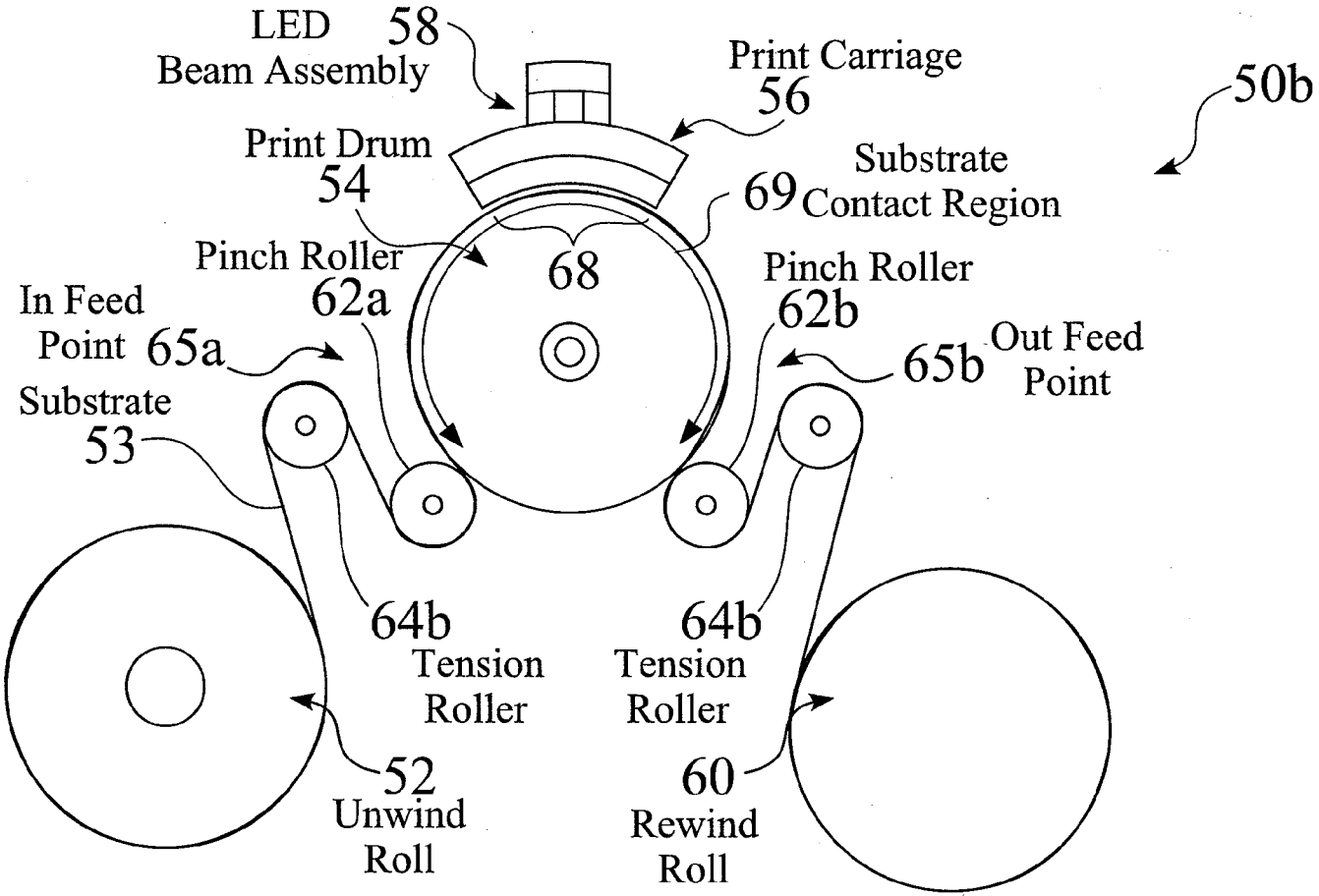
FIG. 4 is a schematic side view of a second exemplary embodiment of an LED Roll to Roll printer.

FIG. 3 is a schematic side view of a first exemplary embodiment of a light emitting diode (LED) Roll to Roll printer 50, e.g. 50*a*. FIG. 4 is a schematic side view of a second exemplary embodiment of an LED Roll to Roll printer 50*b*. LED Roll to Roll printers 50, e.g. 50*a* (FIG. 1), 50*b* (FIG. 2), comprise a drum structure 54 that provides a print platen for a substrate 53, in combination with a print carriage 56 and one or more LED curing assemblies 58.

As seen in FIG. 3 and FIG. 4, the print drum 54 is typically configured to receive a substrate 53 for printing, wherein the substrate 53 is movable 110

(FIG. 7, FIG. 8) between an unwind roll 52 and a rewind roll 60. The print drum 54 is cylindrical, having a diameter 55, which may preferably be sufficiently sized to provide a curved surface 57 where one or more print heads 72 (FIG. 5. FIG. 6) are located at a head height 142 (FIG. 9), e.g. within 1.5 to 2 mm, from the surface of the substrate 53.

The print drum 54 may preferably be at least partially comprised of a material with good dimensional stability, such as but not limited to any of ceramic, a carbon fiber composite, nickel alloy (e.g. Hastelloy C®, available through Haynes International Inc., Kokomo, Ind.), stainless steel, titanium, or alloys thereof. For some embodiments of LED roll to roll drum printers 50, the print drum 54 may preferably be comprised of an inner structure 114 (FIG. 7, FIG. 8), such as a cylindrical core comprising a polymer and/or metal, with an outer shell 116 (FIG. 7, FIG. 8), e.g. natural or synthetic rubber, a polymer, ceramic, a carbon fiber composite, nickel alloys (e.g. Hastelloy C®), stainless steel alloys, titanium, or alloys thereof. The print drum 54 may preferably be at least partially hollow, such as comprising holes or chambers 117 defined there through, wherein the weight, cost, and/or rotational inertia can be controlled. Print drums 54 that are at least partially hollow 117 provide rapid cooling as the drum rotates 110 (FIG. 7), thus reducing or eliminating heat build up over time.

During a printing process, e.g. 220 (FIG. 12), the print drum 54 may preferably be controllably stepped 112 (FIG. 7) or kept in continuous rotation 110. For exemplary LED drum printers 50 having continuous rotation 110, e.g. at a set speed, the printer 50 may preferably raster the image signal or data file 145 (FIG. 9) to correctly build up the image 242 (FIG. 13), such as through a central controller 144 (FIG. 9) and/or through an ink system local control module 88 (FIG. 6). In some exemplary embodiments 50, the substrate 53 moves 110 slowly, while the heads 72 move rapidly, e.g. 102,104 (FIG. 7), such as parallel to the drum axis 103 along one or more support rails 84, wherein the image 242 is built up, with consideration of the combined movements, e.g. 110,102.

LED drum printers 50 provide accurate positioning and motion of the substrate 53, resulting in accurate drop placement 72, since the substrate 53 is inherently wrapped over a large contact region 69 of the convex cylindrical contour 94 (FIG. 6) of the print drum 54, which is typically much larger than the print zone region 68 (FIG. 3). As well, substrates 53 in LED drum printers 50 are not deformed by elevated temperatures, since LED curing stations 58 run cool.

The substrate 53 is placed around the drum 54, and held in place by cylindrical pinch rollers 62, e.g. 62*a*,62*b*. In the first exemplary embodiment of the LED roll to roll drum printer 50 seen in FIG. 3, the pinch rollers 62*a*,62*b* are located towards the bottom of the print drum 54, such as at an in-feed point 65*a* and an out-feed point 65*b*. Once the substrate 53 is located on the print drum 54, friction 176 (FIG. 9), such as between the substrate 53 and the print drum 54, and/or tension applied by the pinch rollers 62, ensures that the substrate 53 does not move or stretch within the print zone 68. The second exemplary embodiment of the LED roll to roll drum printer 50 seen in FIG. 4 further comprises one or more tension rollers 64, such as a first tension roller 64*a* between the first pinch roller 62*a* and the unwind roll 52, and/or a second tension roller 64*b* between the second pinch roller 62*b* and the rewind roll 60.

Control of motion for the print drum may typically comprise an encoder 146 (FIG. 9) and a corresponding motor 148 (FIG. 9), wherein the encoder 146, such as linked to or associated with a central controller 144, provides a signal or otherwise communicates with the motor 148, and wherein the motor 148 is associated with a drive mechanism 150 for moving 110 the print drum 54, e.g. such as directly or indirectly. In some system embodiments 50, the print drum 54, along with the substrate 53, may preferably move, e.g. step 112 (FIG. 7, FIG. 8), within at least 0.25 of a pixel diameter with regards to accuracy. For example, for an LED Roll to Roll printer 50 having a printing resolution of 1,200 dots per inch (dpi), movement 110 may preferably be stepped or otherwise controlled 112 to be equal or less than 0.0002 inch.

Figure 1:
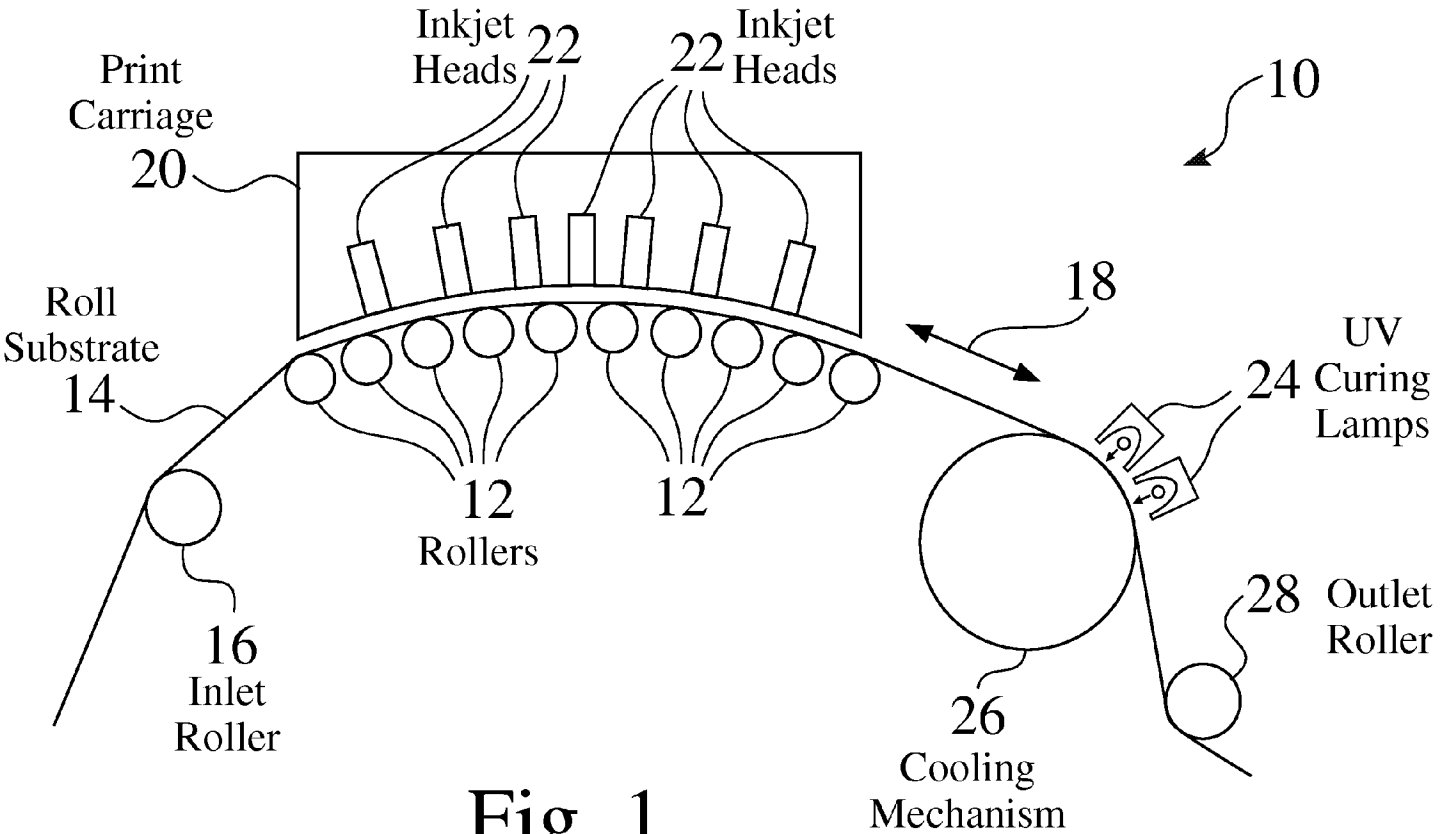
Fig. 1 (PRIOR ART)
FIG. 1 shows an exemplary roll to roll printer having UV curing.

The drum structure 54 therefore provides a print platen having a convex cylindrical contour 94 (FIG. 6) within a printing zone 68, wherein the drum 54 is also used to drive the substrate 53 in combination with a print carriage 56 having a corresponding cylindrical contour 94, and one or more LED curing stations 58. The LED curing stations 58 allow curing 232 (FIG. 12) of ink delivered 226 (FIG. 12) to a substrate 53 located on the surface of the drum 54, while inherently reducing or eliminating heat load upon the substrate 53 and/or drum 54, such as compared with UV lamps 24 (FIG. 1). Current suppliers of LED sensitive inks include 3M, Inc. of St. Paul Minn.; ImTech Inc., of Corvallis, Oreg.; Agfa Graphics, of Mortsel, Belgium; and Sun Innovations, of Novosibirsk, Russia.

A current exemplary embodiment of the LED drum printer system 50, operating at full power, shows a temperature range of a substrate 52 of about 70 to 100 degrees F., while the temperature of the drum roller is less that that of the substrate 53, when printing and moving the moving over drum roller 54, while the temperature of the drum roller 54 shows a temperature of about 80 degrees F. when the substrate 53 is not present.

In different printing systems, a key temperature is at the surface of a substrate, e.g. 14,40 53, when a dark or black image 242, e.g. delivered ink 242, is present, since dark colors absorb more heat, wherein differential expansion due to variable print density can occur. Such differential expansion can result in fluting or buckling of the substrate in prior printing systems, such that the substrate does not move correctly and/or may hit the heads.

LED curing stations 58 therefore reduce or eliminate fluting, buckling, or other changes in the substrate gap 59,142, which may otherwise occur with other curing energy sources, e.g. UV lamps 24. As well, LED Roll to Roll printers 50 retain accurate substrate motion control, since the operating temperature of the print drum 54 and substrate 53 is inherently more consistent, as compared to printers having other curing energy sources, e.g. UV lamps 24.

The drum structure 54, in combination with LED curing stations 58 provides high print quality for a wide variety of printed matter, and is cost effective as compared to prior printing systems. As well, the drum structure 54 and associated mechanisms, e.g. rollers 52, 60, 62, 64, are robust in nature, and can readily be implemented for a wide variety of printing formats and applications.

Figure 5:
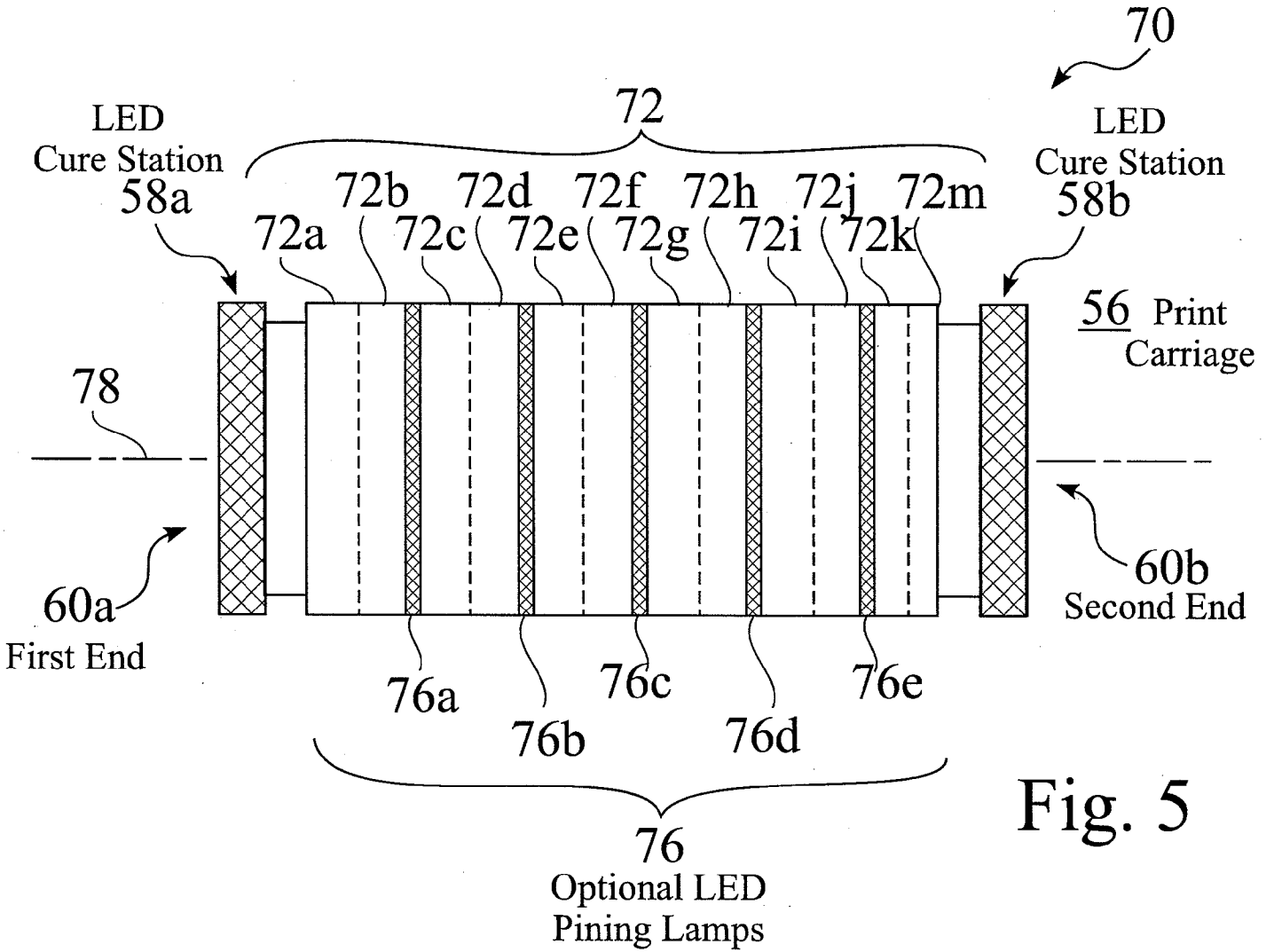
FIG. 5 is a schematic bottom view of an exemplary printer carriage for an LED Roll to Roll printer.
Figure 6:
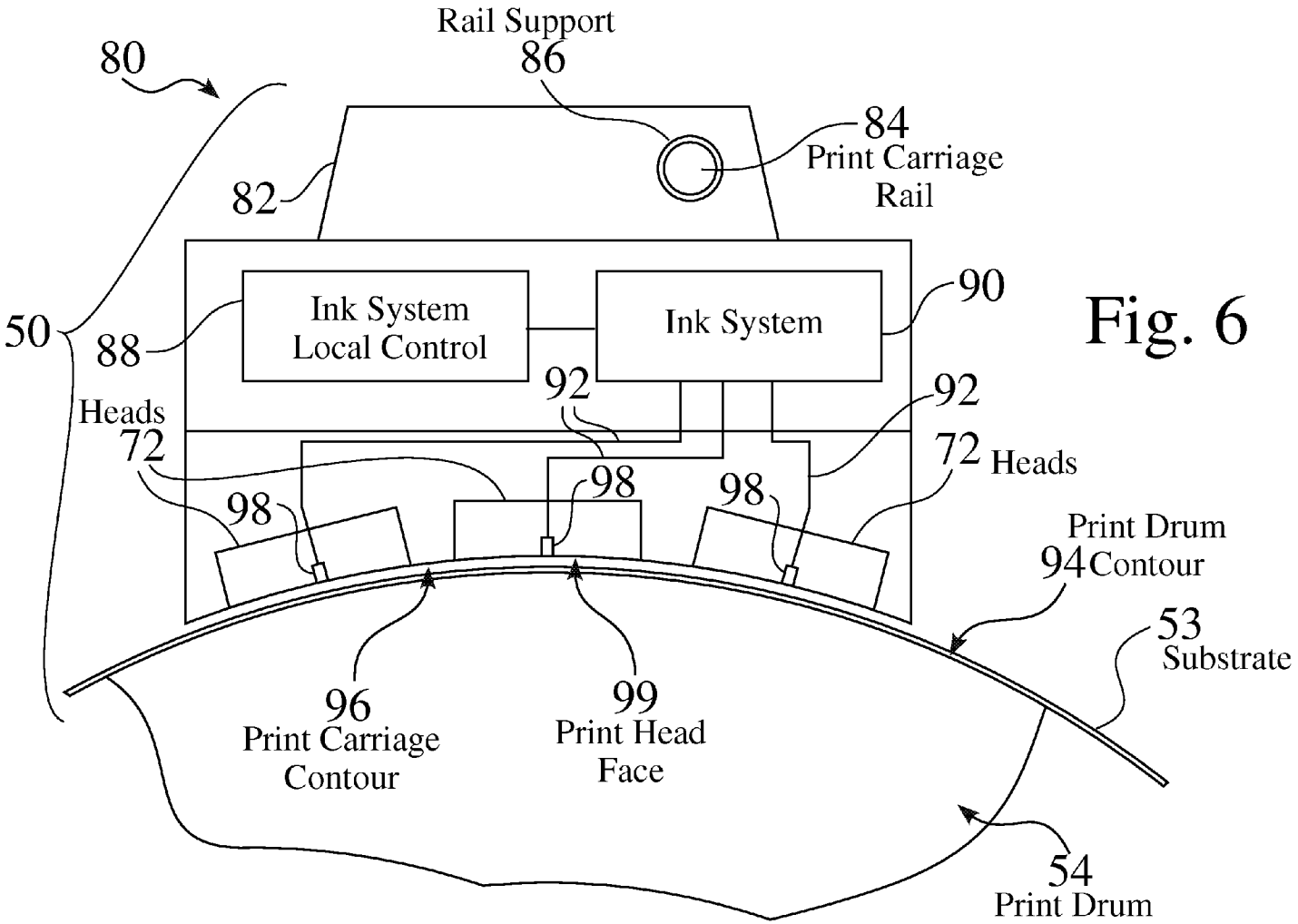
FIG. 6 is a schematic side view of an exemplary printer carriage for an LED Roll to Roll printer.
Figure 7:
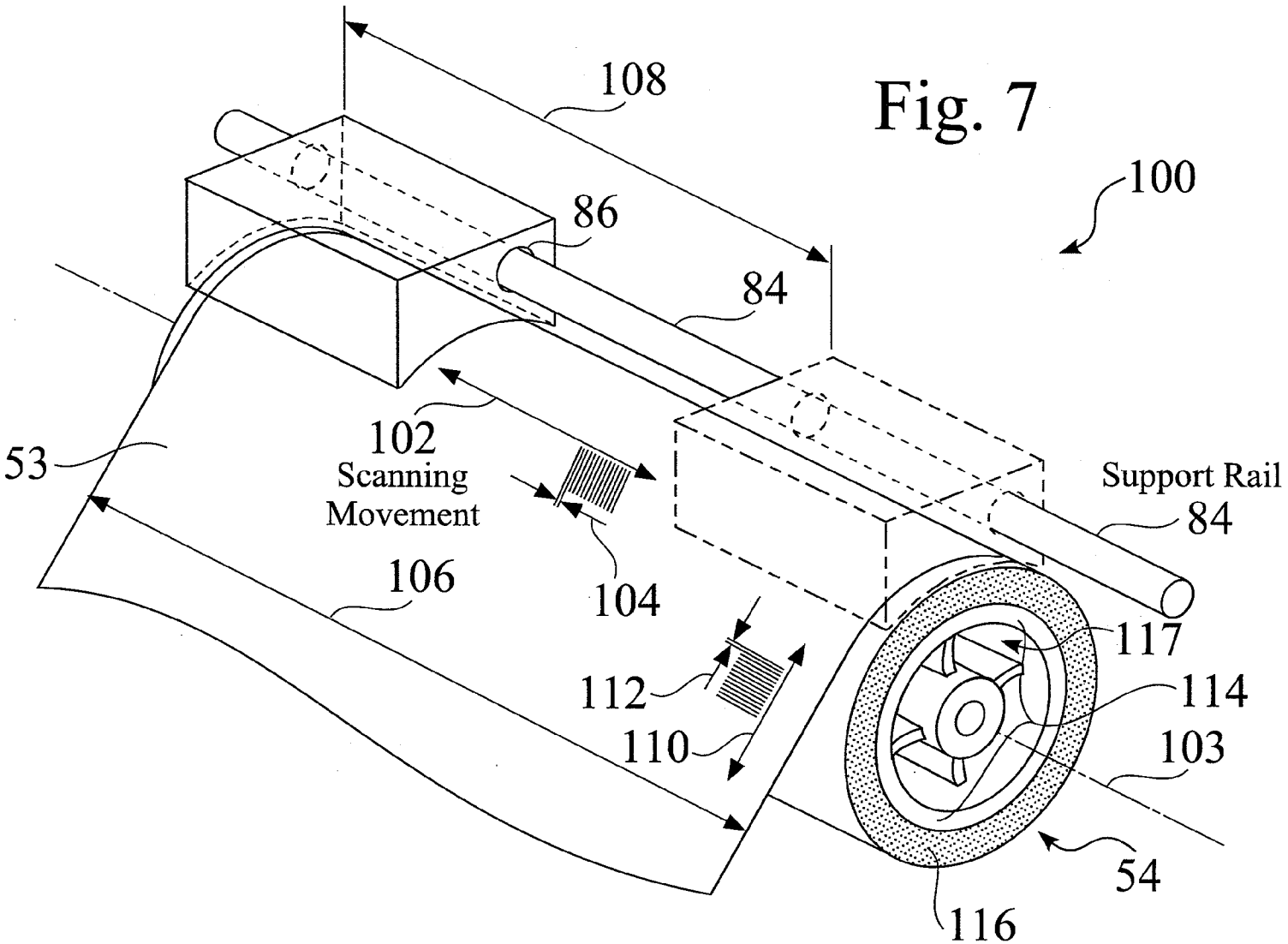
FIG. 7 is a schematic partial perspective view of a scanning print carriage and drum for an exemplary LED Roll to Roll printer.

FIG. 5 is a schematic bottom view 70 of an exemplary printer carriage 56 for an LED Roll to Roll printer 50. FIG. 6 is a schematic side view 80 of an exemplary printer carriage 56 for an LED Roll to Roll printer 50. The exemplary printer cartridge 56 seen in FIG. 5 comprises one or more print heads 72, e.g. 72*a*-72*m*, such as to provide a plurality of color channels, such as for but not limited to CMYK process color printing, comprising cyan (C), magenta (M), yellow (Y), and black (K); and/or one or more spot colors, e.g. Pantone® colors. In some embodiments of the print carriage 56, the carriage axis 78 may preferably be perpendicular to the motion 110 (FIG. 7) of the substrate 53, and parallel to the print drum axis (FIG. 7). In other embodiments of the print carriage 56, the carriage axis 78 may preferably be parallel to the motion 110 of the substrate 53, and perpendicular to the print drum axis.

As seen in FIG. 6, the print carriage 56 typically has a defined concave carriage contour 96, wherein the ink jets 98 of the print heads 72 are typically located at a defined height 59,142 (FIG. 3, FIG. 9) from the print drum 54 having a corresponding convex cylindrical contour 94.

Figure 9:
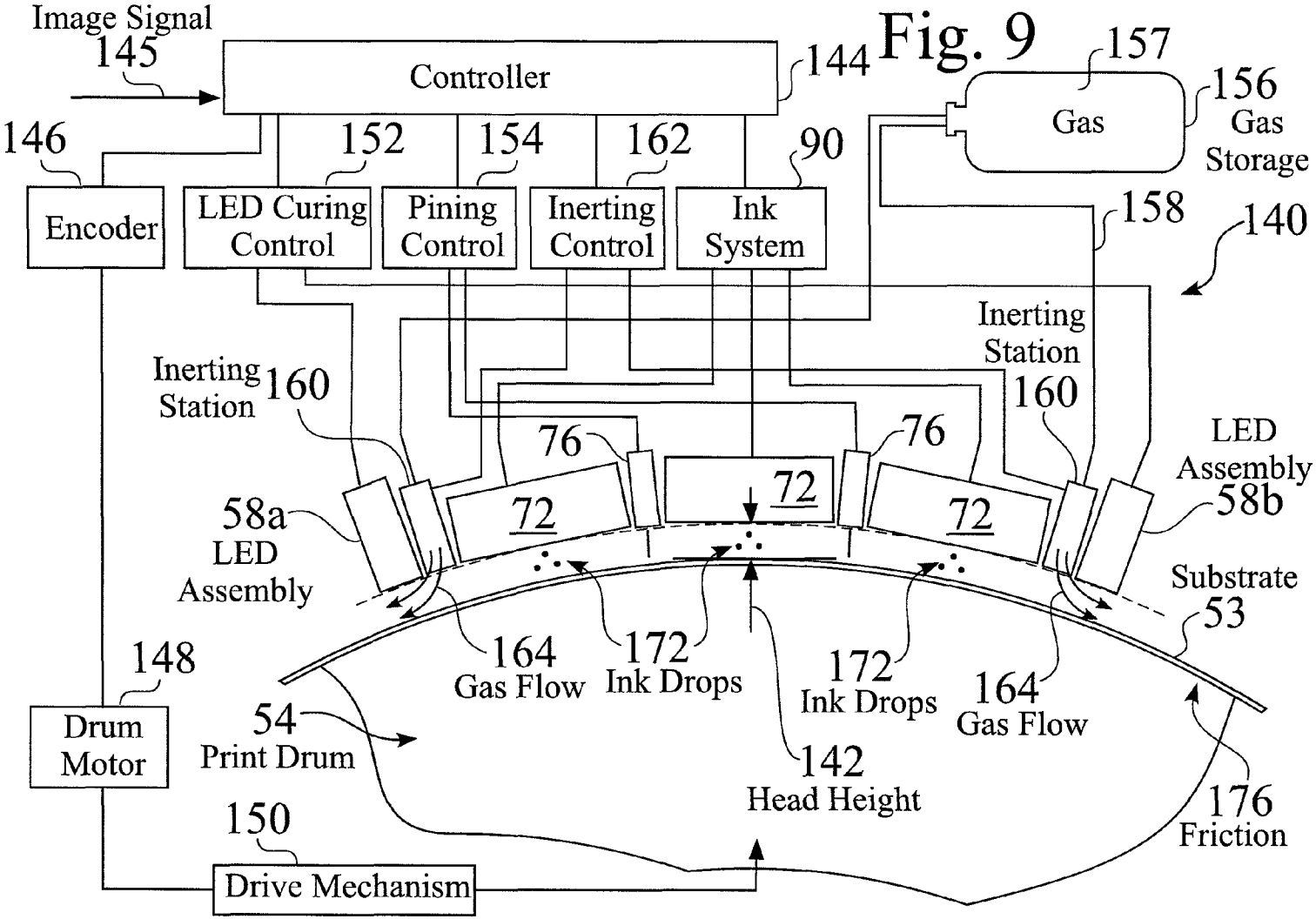
FIG. 9 is a schematic view of controls and subsystems for some embodiments of LED roll to roll printers.

The exemplary print heads 72 as seen in FIG. 5 and FIG. 6 are typically driven by local control electronics 88, an ink delivery system 90, e.g. ink cartridges, and associated plumbing 92, wherein ink drops 172 (FIG. 9) are controllably jetted onto the substrate 53, such as in accordance with an incoming image signal 145 (FIG. 9).

The exemplary print carriage 56 seen in FIG. 5 also comprises one or more LED cure stations 58, e.g. 58*a*,58*b*, wherein each of the LED cure stations 58 comprise LED elements 184 (FIG. 10) for applying light 250 (FIG. 13) to cure, i.e. dry, the delivered ink 172 located upon the substrate 53. As seen in FIG. 5, most current system embodiments 50 comprise two or more LED cure stations 58, e.g. 58*a*,58*b*, such as located at opposing ends 60*a*, 60*b* of the print carriage 56. While the exemplary print carriage 56 shown in FIG. 5 comprises the LED cure stations 58, e.g. 58*a*,58*b* attached at opposing ends 60*a*,60*b*, the LED cure stations 58 may alternately be separately located from the print carriage 56 within the LED Roll to Roll printing system 50. The LED cure stations 58 typically provide full cure of the inks 172, such as over a number of specified passes of the substrate 53 in relation to one or more corresponding LED cure stations 58, and the power level can be controlled accurately, such as through LED curing control 152 (FIG. 9).

The exemplary print carriage 56 seen in FIG. 5 further comprises one or more LED pining stations 76, e.g. 76*a*-76*e*, such as between one or more banks of print heads 72, wherein each of the LED pining stations 76 comprise LED pining elements 204 (FIG. 11) for applying light 246 (FIG. 13) to control or stop the spread of the delivered ink drops 172 located upon the substrate 53. In some embodiments of LED Roll to Roll printers 50, the number and frequency of pining stations 76 may be vary from just one pining station 76, such as placed in the center of the print carriage, e.g. between LED cure stations 58, to a plurality of LED pining stations 76, e.g. having an LED pining station 76 for each bank of heads 72. LED pining stations 76 may preferably be thin and/or have relatively low power, such as compared to LED cure stations 58, wherein the LED pining stations 76 may provide sufficient power to control or stop the spread of delivered ink drops 172 (FIG. 9). LED pining stations 76 may therefore reduce negative impact to print quality of differential drop spread and ink/ink interactions.

LED Roll to Roll printers 50 provide accurate drop placement, controlled drop spread, and minimal drop interaction, thus yielding excellent drop addressability and print quality, such as through:

holding media 53 to the drum 54
accurate step movement;
correct choice of print-head; and
optional pining.

As seen in FIG. 6, the print carriage may be supported with respect to the print drum 54 by one or more rails 84 that are mounted parallel to the drum 54, such by corresponding rail support mechanisms 86 associated with a structure 82. The print carriage 56 may be fixedly attached to the rail 84, such as for a print carriage 56 that extends across the width of the print drum 54. Alternately, the print carriage 56 may be moveable along the rail 84, such as for a print carriage 56 that scans across the width of a substrate 53 located on the print drum 54.

Figure 8:
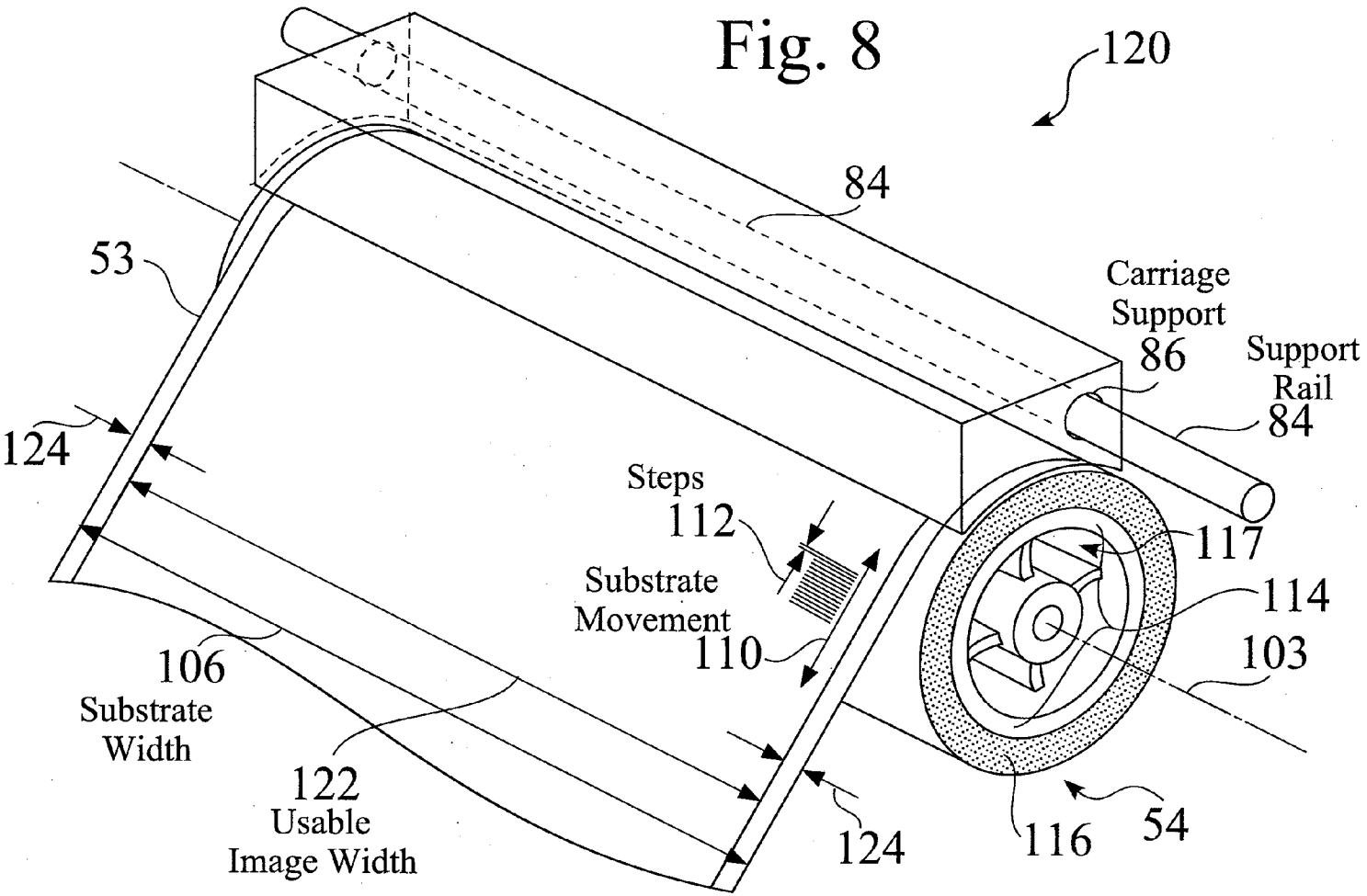
FIG. 8 is a schematic partial perspective view of a print carriage that extends across a print drum for an exemplary LED Roll to Roll printer.

FIG. 7 is a schematic partial perspective view 100 of a print drum and scanning print carriage 56 for an exemplary LED Roll to Roll printer 50. FIG. 8 is a schematic partial perspective view 120 of print carriage 56 that extends across a print drum 56 for an exemplary LED Roll to Roll printer 50.

As seen in FIG. 7, a print carriage 56 may preferably be moved 102 by scanning in relation to the print drum 54, such as by carriage step increments 104. The exemplary print carriage 56 seen in FIG. 7 is movably mounted on a support rail 84, and may preferably be moved 102 across a carriage range 108, wherein the print heads 72 may deliver ink drops 172 (FIG. 9) 72 across a usable image width of the substrate 53, which may extend over the entire width 106 of the substrate 53, or may be controllably limited to a region 122 (FIG. 8) within the substrate width 106, such as to provide a minimum margin 124 on the outer edges of the substrate 53. LED drum printers 50 having a scanning, i.e. movable, print drum 54 for single pass printing can be used for a wide variety of printing applications, such as for not limited to billboards, signage, POP applications, e.g. Wide Format (WF) and/or Super Wide Format (SWF). For example, a scanning pass print carriage 56 is readily provided for substrate applications having a substrate width 106 of up to 50 inches, such as commonly required for labels, billboards, signage, and/or POP applications.

The exemplary print carriage 56 seen in FIG. 8, such as comprising a print plate 56, extends across the print drum 54, and is fixedly mounted to one or more support rails 84, wherein stationary print heads 72, e.g. a plurality of print heads 72 for delivering a plurality of colors, controllably deliver ink drops 172 across the usable image width 122 of a substrate 53. The usable image width 122 of a substrate 53 may extend over the entire width 106 of the substrate 53, or may be controllably limited to a region within the substrate width 106, such as to provide a minimum margin 124 on the outer edges of the substrate 53. LED drum printers 50 having a stationary print drum 54 for single pass printing can be used for a wide variety of printing applications, such as but not limited to labeling and packaging printing. For example, a stationary single pass print carriage 56 is readily provided for substrate applications having a substrate width 106 of 12 inches, such as commonly used for labels.

The exemplary print carriage or plate 56 seen in FIG. 8 may comprise a long LED array 182 (FIG. 10) that extends across the width of the drum 54, a given distance from the final print-head array, such as before an exit nip or pinch roller 62. The exemplary print carriage or plate 56 seen in FIG. 8 may alternately comprise a plurality of LED arrays 182.

For different embodiments of LED drum printers 50, the diameter 55 of the print drum 54, having a corresponding convex contour 96, and the corresponding concave contour 97 of the print carriage 56, may preferably be chosen based on one or more other parameters of the LED drum printer, such as but not limited to the configuration of the printer carriage 56, e.g. scanning or stationary, and/or the configuration of the print heads 72, e.g. perpendicular to the direction of substrate travel 110, such as for a stationary single pass LED drum printer 50 having a carriage that extends across the print drum 54, or parallel to the direction of substrate travel 110, such as for a scanning LED drum printer 50 having a carriage that moves 102 (FIG. 7) across the print drum 54.

As print heads 72 typically comprise a large number of inkjet nozzles 98, the distance between different nozzles 98 to the substrate 53 and print drum 54 may vary slightly for some printer embodiments 50. As an example, for print heads 72 that have a flat head face 99 (FIG. 6), nozzles 98 that located close to the center of the face 99 may be closer to the substrate 53 than nozzles 98 that are located away from the center of the head face 99. The time of flight for ink drops 172 (FIG. 9) increases based on the distance between the nozzles 98 and the substrate 53. Some embodiments of LED drum printers 50 are preferably configured to minimize differences in flight time, wherein the distance between the ink nozzles 98 and the substrate 53 is relatively similar across the print heads, e.g. such as but not limited to having a nozzle to substrate distance of 1 mm to 1.4 mm, or alternately having a maximum differential distance, e.g. 0.5 mm. In some embodiments of LED printers 50, the length of the print heads 72 and the diameter 55 of the print drum 54 may preferably be chosen to minimize such differences in flight time. As well, some embodiments of LED printers 50 have heads configured on a sabre angle to minimize differences in flight time. Some embodiments of LED printers 50 may preferably compensate for differences in flight time, e.g. through ink system local control 88 and/or through a central controller 144 (FIG. 9), such as by controlling the timing of drop firing 226 (FIG. 12) for one or more nozzles 98. For some embodiments of single pass LED drum printers 50, wherein the heads 72 are placed perpendicularly to the drum motion 110, such length considerations are less of an issue, e.g. wherein the distance between the ink nozzles 98 and the substrate 53 falls well within a maximum differential distance.

Figure 12:
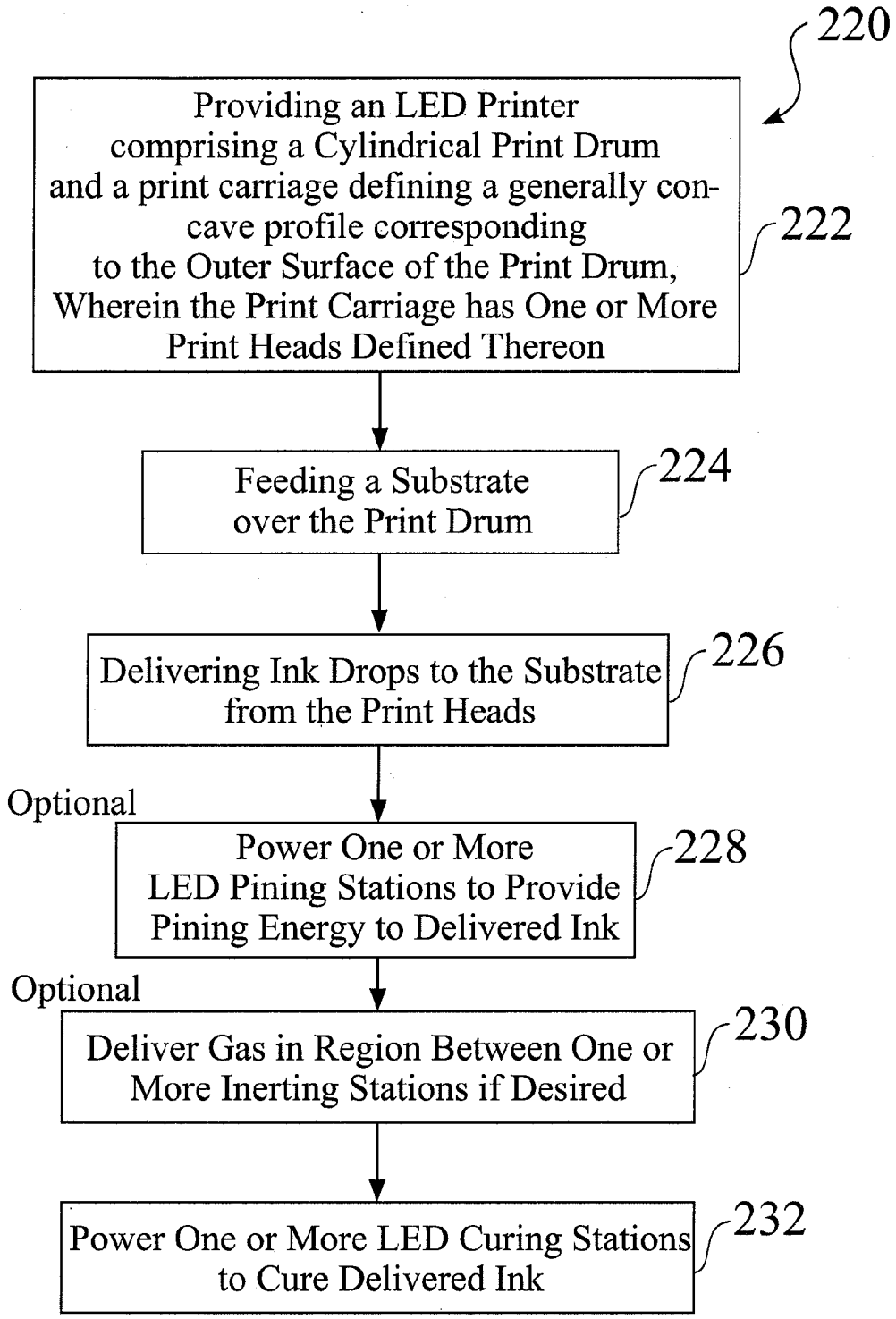
FIG. 12 is a flowchart of an exemplary process associated printing with an LED Roll to Roll printer.

FIG. 9 is a schematic view 140 of controls and subsystems for some embodiments of LED Roll to Roll printers 50, such as for controlled movement of the print drum 54, controlled delivery of ink drops 172, and controlled LED curing 232 (FIG. 12). The exemplary system embodiment seen in FIG. 9 also preferably comprises one or more inerting stations 160, and one or more pining stations 76, with associated controls.

As seen in FIG. 9, movement of a print drum 54 may comprise an encoder 146 and a corresponding motor 148, wherein the encoder 146, such as linked to or associated with a central controller 144, provides a signal or otherwise communicates with the motor 148, and wherein the motor 148 moves the print drum 54, e.g. such as directly or indirectly through a drive mechanism 150, to move 110 the substrate 53, such as in step increments 112, e.g. to provide a desired resolution with delivered ink drops 172.

As also seen in FIG. 9, an ink delivery system 90, such as comprising ink cartridges, and associated plumbing 92, is typically driven by a central controller 144 and/or by local control 88 (FIG. 6), to controllably jet ink drops 172 from one or more of the print heads 72 onto the substrate 53, such as in accordance with an incoming image signal 145.

As further seen in FIG. 9, one or more LED curing stations 58, e.g. **58*a*,58*b* are controlled by any of a central controller 144 and/or LED curing control 152, to emit light from one or more LED elements 184 (FIG. 10) to cure, i.e. dry, delivered ink droplets 172 located on the substrate 53**.

The exemplary LED Roll to Roll printer 50 seen in FIG. 9 preferably comprises one or more LED pining stations 76, such as controlled by any of a central controller 144 and/or LED pining control 154, to emit 228 (FIG. 12) light 246 (FIG. 13) from one or more LED pining elements 204 (FIG. 11), such as to provide sufficient power 228 to control or stop the spread of the delivered ink drops 172 located upon the substrate 53.

LED Roll to Roll printers 50 may preferably further comprise means for delivering a gas 157, e.g. such as comprising any of an inert gas or a gas at least partially depleted of oxygen, between the LED curing stations 58 and the substrate 53. Similar delivery of a gas may preferably be provided at or near one or more pining stations 76, to similarly deliver 164 a gas 157 between the LED pining stations 76 and the substrate 53. The exemplary LED Roll to Roll printer 50 seen in FIG. 9 preferably comprises a vessel 156 for storing and dispensing a gas 157, such as but not limited to an inert gas, e.g. nitrogen. Gas 157 is typically transported through lines 158 to inerting stations 160 that are located at or generally adjacent to corresponding LED curing stations 58. Delivery of the gas 157 may preferably be controlled by of a central controller 144 and/or inerting control 162, to introduce a layer 164 of gas 157 between the LED curing stations 58 on or near the print carriage 56, and the substrate 53 located on the outer surface 94 of the print drum 54, such as to deplete the level of oxygen in the print zone, e.g. for any of improving the quality of the cured ink, or reducing the power required to cure the delivered ink 172.

Figure 10:
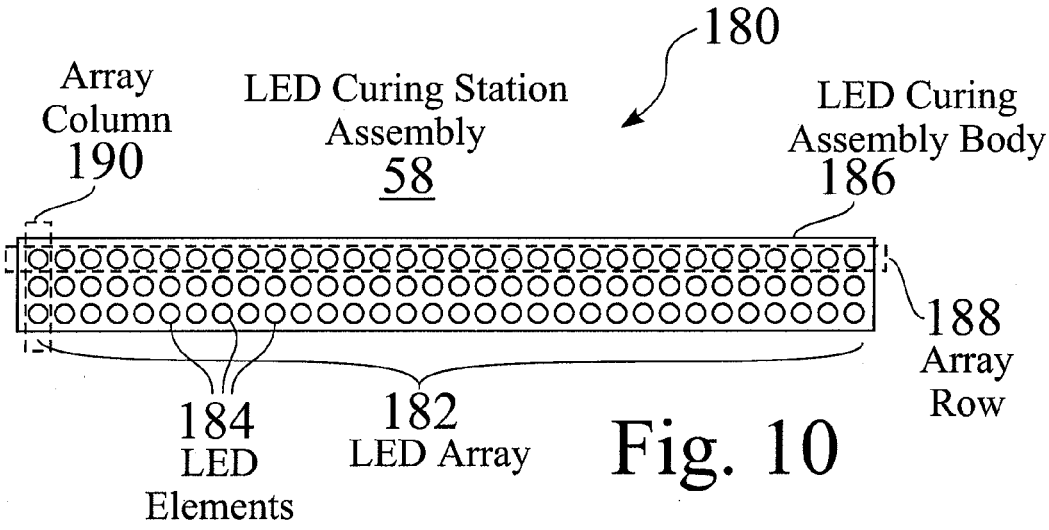
FIG. 10 is a schematic view of an exemplary LED curing station assembly.

FIG. 10 is a schematic view 180 of an exemplary LED curing station assembly 58, which typically comprises an array 182 on one or more LED elements 184, such as mounted or otherwise affixed to a curing assembly body 186. The exemplary LED array 182 seen in FIG. 10 comprises a plurality of LED elements 184 arranged in rows 188 and columns 190. Since LED elements 184 are typically robust, LED curing station assemblies 58 reliably provide LED curing over an extended lifetime. As well, since LED curing station assemblies 58 often comprise a plurality of LED elements 184, LED curing assemblies 58 may preferably provide redundancy. For example, even if some of the LEDs fail, most of the LED elements continue to operate to provide curing 232, thus reducing loss of output and/or preventing printer downtime. Current suppliers of LED light sources for curing and/or pining include Exfo, Inc., of Quebec, Canada; Phoseon Technology, of Hillsboro, Oreg.; Integration Technology North America, of Chicago, Ill.; and Baldwin Technology Co., of Shelton, Conn.

Figure 11:
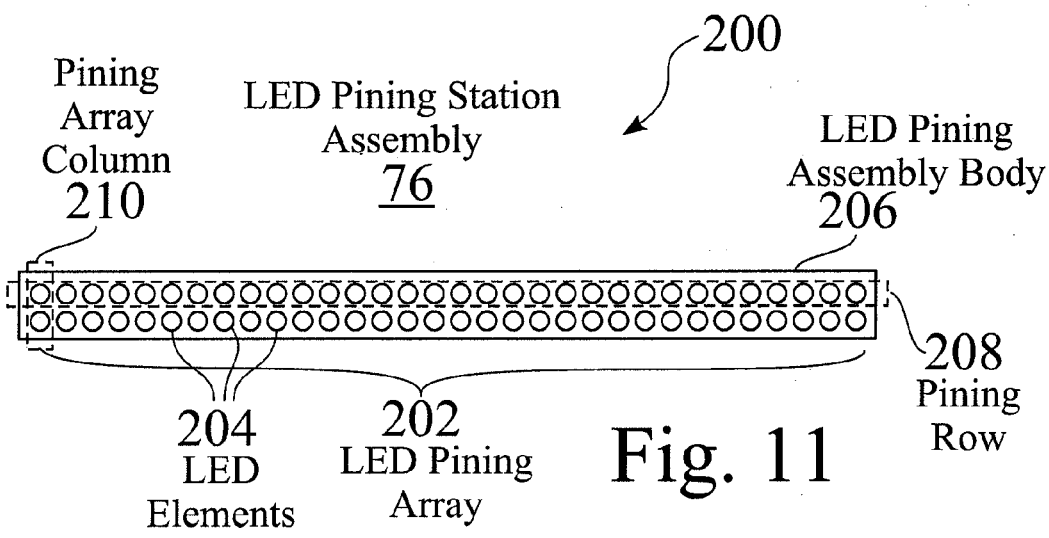
FIG. 11 is a schematic view of an exemplary LED pining station assembly.

FIG. 11 is a schematic view 200 of an exemplary LED pining station assembly 76, which typically comprises an array 202 on one or more LED elements 204, such as mounted or otherwise affixed to a pining assembly body 206. The exemplary LED pining array 202 seen in FIG. 11 comprises a plurality of LED pining elements 204 arranged in rows 208 and columns 210. Since LED elements 204 are typically robust, LED pining station assemblies 76 reliably provide LED pining 228 over an extended lifetime. As well, since LED pining station assemblies 76 often comprise a plurality of LED elements 204, LED curing assemblies 76 may provide redundancy for pining functionality. For example, even if some of the LEDs 204 fail, most of the LED elements 204 continue to operate to provide pining 228, thus reducing loss of output and/or preventing printer downtime.

FIG. 12 is a flowchart of an exemplary process 220 associated with an LED Roll to Roll printer 50. An LED Roll to Roll printer 50 is first provided 222, wherein the printer 50 comprises a cylindrical print drum 54, one or more LED curing stations, and a print carriage 56 defining a generally concave region 96 that generally corresponds to the outer surface contour 94 of the print drum 54, wherein the print carriage comprises one or more print heads 72 having jets 98 located on the generally concave surface 96. A substrate 53 is then fed 224 over the print drum in relation to the print carriage 56, and ink drops 172 are delivered 226 onto the substrate 53, such as corresponding to an input signal or data file 145, e.g. to create an image, text, pattern, or any combination thereof. For embodiments of the LED printer 50 having one or more pining stations 76, one or more of the stations 76 may be powered 228, such as in coordination with ink delivery 226, movement of the roller 54, and or movement of the printer carriage 56, e.g. scanning 102, to slow or stop spread of the delivered ink 172. For embodiments of the LED Roll to Roll printer 50 having one or more inerting stations 160, one or more of the inerting stations 160 may preferably provide 230 inerting gas 157, such as in conjunction with the powering 232 of one or more LED curing stations to cure the delivered ink 172.

Figure 13:
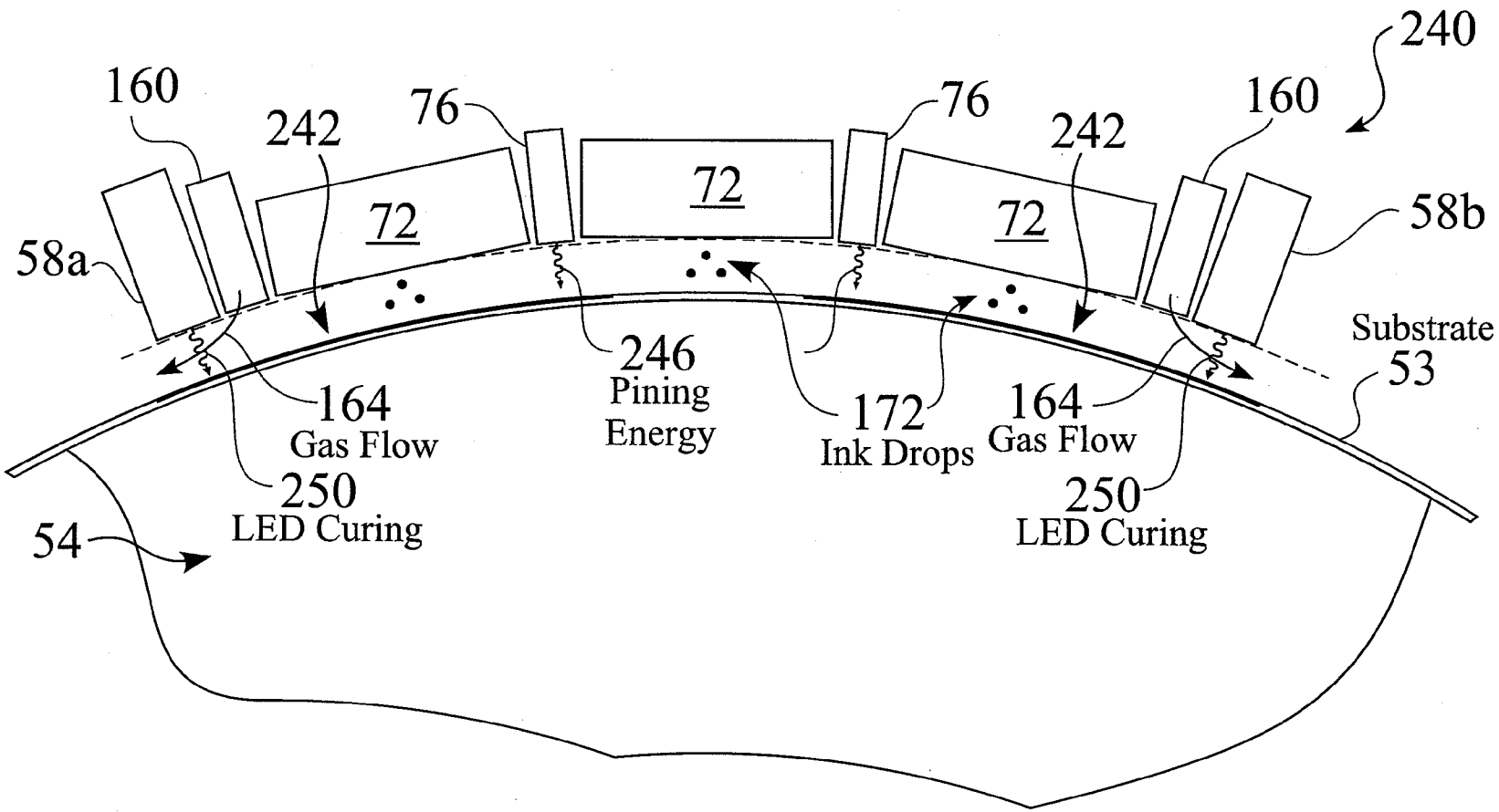
FIG. 13 is a partial close up view of ink delivery, pining and curing for an exemplary LED printer.

FIG. 13 is a partial close up view 240 of ink delivery, pining and curing for an exemplary LED Roll to Roll printer 50. For example, ink droplets 172 are jetted by the print heads 72 onto the substrate 53. For LED Roll to Roll printers 50 having pining stations 76, pining elements 204 may controllably be powered to emit pining energy 246, such as to slow or stop the spread of delivered ink 242, e.g. a printed image 242, on the substrate 53. LED curing stations 58, e.g. 58*a*,58*b*, are controllably powered to emit curing energy 250, to cure delivered ink 242 on the substrate 53. As well, for LED Roll to Roll printers 50 having inerting stations 160, gas may controllably be distributed between the curing stations and the substrate 53. Similarly, inerting stations 160 may preferably distribute gas 157 between the pining stations 76 and the substrate 53 if desired.

The LED Roll to Roll printers 50 combine LED curing systems 58 with drum based printer designs, to take advantage of low temperature curing provided though LED Curing assemblies 58. LED Roll to Roll printers 50 may also preferably provide pining stations 76, e.g. LED pining assemblies 76, to slow or stop the flow of delivered ink. LED Roll to Roll printer configurations 50 are relatively lower in cost to manufacture than prior printer designs, and provide high print quality, such as may be required for a wide variety of printing applications, such as but not limited to any of POP, labels, packaging, and/or photorealistic applications.

The cool LED lamp elements 184 allow printing onto the drum without heating the drum up, thus preventing or reducing changes in substrate gap due to temperature changes, and providing accurate substrate motion control. The use of the drum 54 significantly simplifies the design of the printer 50 to allow both print quality improvements and cost reductions.

Some embodiments of the LED drum printers 50, such as for but not limited to Super Wide Format (SWF) and Wide Format (WF) printers, comprise two sets of rollers to control motion 110 of the substrate 53, and a central drum platen 54 to support the substrate 53 during the printing process. The rollers 62,64 are preferably comprised of rubber, and may preferably have a high dimensional tolerance, to provide even and accurate drive across a substrate 53, such as for substrates 53 having a width 106 (FIG. 7,FIG. 8) of up to 5 meters.

In many prior printer designs, changes in pressure on substrates may create motion inaccuracies that may lead to drop placement errors, while substrate slip can also be a factor, such as when using different substrates. In contrast to prior platen designs, LED drum printers 50 may preferably reduce or eliminate motion errors due to any of variations in the platen surface, material build up, and/or thermal variances.

While some mechanisms are described herein with respect to specific embodiments of LED printers 50, some of the mechanisms may readily be used within different printing environments. For example, while the LED pining assemblies are described herein as being used for LED Roll to Roll printers, such LED pining assemblies may provide pining for other configurations, such as for other printers having UV curing, wherein the spread of such inks may be controllably slowed or stopped through LED pining.

Accordingly, although the invention has been described in detail with reference to a particular preferred embodiment, persons possessing ordinary skill in the art to which this invention pertains will appreciate that various modifications and enhancements may be made without departing from the spirit and scope of the claims that follow.

The invention claimed is:

1. A printing system, comprising:

a print drum having a cylindrical outer contour for receiving a substrate there upon;

a print carriage having a generally concave inner contour defined there upon, and having a first end and a second end opposite the first end, wherein the print carriage comprises one or more print heads for controllably jetting ink onto the substrate, a plurality of LED curing assemblies for curing the jetted ink on the substrate, wherein a first LED curing assembly of the LED curing assemblies is located at the first end of the print carriage, and a second LED curing assembly of the LED curing assemblies is located at the second end of the print carriage, and at least one pining station located between the first LED curing assembly and the second LED curing assembly, wherein each of the at least one pining station comprises an array of light emitting diodes (LEDs) for delivering light energy to the jetted ink on the substrate for any of controlling or stopping spread of ink drops before curing by the LED curing assemblies; and a drive mechanism for rotating the print drum and substrate in relation to the print carriage.

2. The printing system of claim 1, further comprising:
at least one rail configured generally parallel to the print drum; and
a mechanism for moving the print carriage along the at least one rail.

3. The printing system of claim 1, wherein the print carriage is fixedly located in relation to the print drum, wherein the substrate has a characteristic substrate width that extends longitudinally along the print drum, wherein the substrate has a defined printable width that is less than or equal to the substrate width, and wherein the print heads are configured to deliver the ink at any point over the defined printable width of the substrate.

4. The printing system of claim 1, wherein the print carriage has a carriage axis defined between the first end and the second end, wherein the carriage axis is any of parallel or perpendicular to the print drum.

5. The printing system of claim 1, wherein the print carriage further comprises a mechanism for delivering a gas over at least part of the substrate.

6. The printing system of claim 5, wherein the gas comprises any of an inert gas or a gas that is at least partially depleted of oxygen.

7. The printing system of claim 6, wherein the inert gas comprises nitrogen.

8. The printing system of claim 5, wherein the mechanism for delivering the gas is configured to deliver the gas between at least one of the LED curing assemblies and the substrate.

9. The printing system of claim 1, wherein the print drum comprises an outer shell that is comprised of any of natural rubber, synthetic rubber, polymer, ceramic, a carbon fiber composite, nickel alloy, stainless steel, titanium, or alloys thereof.

10. The printing system of claim 1, further comprising:
an unwind roll; and
a rewind roll;
wherein the substrate is rollably moveable over the print drum between the unwind roll and the rewind roll.

11. The printing system of claim 10, further comprising:
at least one pinch roller between the print drum and any of the unwind roll and the rewind roll, wherein the pinch roller is configured to hold the substrate in contact with the outer contour of the print drum.

12. The printing system of claim 11, further comprising:
at least one tension roller between the pinch roller and any of the unwind roll and the rewind roll, wherein the tension roller is configured to apply tension to the substrate.

13. The printing system of claim 1, wherein the print drum and print carriage are configured to provide printing for any of labels, billboards, signage, or point of purchase applications.

14. A method, comprising the steps of:
providing a printer comprising a cylindrical print drum for receiving a substrate there upon, and
a print carriage having a first end and a second end opposite the first end, the print carriage defining a generally concave region that generally surrounds at least a portion of the outer surface of the print drum, wherein the print carriage comprises
one or more print heads having ink jets located on the generally concave surface for jetting ink,
a plurality of LED curing assemblies for curing the jetted ink on the substrate, wherein a first LED curing assembly of the LED curing assemblies is located at the first end of the print carriage, and wherein a second LED curing assembly of the LED curing assemblies is located at the second end of the print carriage, and
at least one pining station located between the first LED curing assembly and the second LED curing assembly, wherein each of the at least one pining station comprises an array of light emitting diodes (LEDs) for delivering light energy to the jetted ink on the substrate for any of controlling or stopping spread of ink drops before curing by at least one of the LED curing assemblies;
feeding a substrate over the print drum in relation to the print carriage;
delivering one or more ink drops onto the substrate;
delivering light energy through the pining station to the jetted ink on the substrate; and
powering at least one of the LED curing stations to cure the pinned delivered ink.

15. The method of claim 14, wherein the printer further comprises:
at least one rail configured generally parallel to the print drum; and
a mechanism for moving the print carriage along the at least one rail.

16. The method of claim 14, wherein the print carriage is fixedly located in relation to the print drum, wherein the substrate has a characteristic substrate width that extends longitudinally along the print drum, wherein the substrate has a defined printable width that is less than or equal to the substrate width, and wherein the print heads are configured to deliver the ink at any point over the defined printable width of the substrate.

17. The method of claim 14, wherein the print carriage has a carriage axis defined between the first end and the second end, wherein the carriage axis is any of parallel or perpendicular to the print drum.

18. The method of claim 14, further comprising the step of:
delivering a gas over at least part of the substrate.

19. The method of claim 18, wherein the gas comprises any of an inert gas or a gas that is at least partially depleted of oxygen.

20. The method of claim 19, wherein the inert gas comprises nitrogen.

21. The method of claim 18, wherein the gas is delivered between at least one of the LED curing assemblies and the substrate.

22. The method of claim 14, wherein the print drum comprises an outer shell that is comprised of any of natural rubber, synthetic rubber, polymer, ceramic, a carbon fiber composite, nickel alloy, stainless steel, titanium, or alloys thereof.

23. The method of claim 14, wherein the printer further comprises:
an unwind roll; and
a rewind roll;
wherein the substrate is rollably moveable over the print drum between the unwind roll and the rewind roll.

24. The method of claim 14, wherein the printer further comprises:
at least one pinch roller between the print drum and any of the unwind roll and the rewind roll, wherein the pinch roller is configured to hold the substrate in contact with the outer contour of the print drum.

25. The method of claim 24, wherein the printer further comprises:
at least one tension roller between the pinch roller and any of the unwind roll and the rewind roll, wherein the tension roller is configured to apply tension to the substrate.

26. The method of claim 14, wherein the printer is configured to print any of labels, billboards, signage, or point of purchase items.

27. A print carriage for printing on a substrate located on a cylindrical print drum, the print carriage comprising:

a carriage body having a first end and a second end opposite the first end, the carriage body having a concave inner contour defined there upon;

one or more print heads having ink jets for controllably jetting ink onto a substrate located on the print drum, wherein the jets are located on the concave inner contour of the carriage body;

a plurality of curing assemblies, wherein each of the curing assemblies comprises one or more light emitting elements (LEDs) for curing the jetted ink on the substrate, wherein a first curing assembly of the curing assemblies is located at the first end of the carriage body, and wherein a second curing assembly of the curing assemblies is located at the second end of the carriage body;

at least one pining station located between the first curing assembly and the second curing assembly, wherein each of the at least one pining station comprises an array of light emitting diodes (LEDs) for delivering light energy to the jetted ink on the substrate for any of controlling or stopping spread of ink drops before curing by at least one of the curing assemblies; and a mechanism for positioning the concave inner contour with respect to the print drum.

28. The print carriage of claim 27, wherein a carriage axis is defined between the first end and the second end, wherein the carriage axis is any of parallel or perpendicular to the print drum.

29. The print carriage of claim 27, further comprising:

a mechanism for delivering a gas over at least part of the substrate.

30. The print carriage of claim 29, wherein the gas comprises any of an inert gas or a gas that is at least partially depleted of oxygen.

* * * * *